US005791545A

United States Patent [19]

Lin

[11] Patent Number: 5,791,545

[45] Date of Patent: Aug. 11, 1998

[54] NAIL STAPLER CAPABLE OF FIRING INTERRUPTEDLY OR CONTINUOUSLY

[76] Inventor: Joseph Lin, 37, 21th Rd. Taichung Industrial Park, Taichung, Taiwan

[21] Appl. No.: 681,393

[22] Filed: Jul. 23, 1996

[51] Int. Cl.[6] ..... B25C 1/04

[52] U.S. Cl. ..... 227/8; 227/130

[58] Field of Search ..... 227/8, 120, 130

[56] References Cited

U.S. PATENT DOCUMENTS

| | | | |
|---|---|---|---|
| 5,083,694 | 1/1992 | Lemos | 227/8 |
| 5,137,197 | 8/1992 | Bauer | 227/8 |
| 5,551,621 | 9/1996 | Vallee | 227/8 |
| 5,593,079 | 1/1997 | Mukoyama et al. | 227/8 |
| 5,597,106 | 1/1997 | Hamano et al. | 227/130 |

*Primary Examiner*—Scott A. Smith

*Attorney, Agent, or Firm*—Browdy and Neimark

[57] ABSTRACT

A nail stapler comprises a stapler body, a safety rod, and a triggering mechanism. The safety rod is located movably between the muzzle and the nail clip of the stapler body. The triggering mechanism comprises a trigger, a pivoting piece and a retaining member. The trigger is fastened pivotally with the stapler body. The pivoting piece is disposed rotatably in the trigger such that the free end of the pivoting piece is capable of being urged by the safety rod to activate the air switch. The retaining member is fastened with the trigger and is provided with a coupling portion capable of engaging the first and the second locating portions of the trigger so as to set the nail stapler in the state of firing nail interruptedly or firing nail continuously.

21 Claims, 10 Drawing Sheets

NAIL STAPLER CAPABLE OF FIRING INTERRUPTEDLY OR CONTINUOUSLY

FIELD OF THE INVENTION

The present invention relates generally to a nail stapler, and more particularly to a nail stapler capable of firing interruptedly or continuously.

BACKGROUND OF THE INVENTION

As shown in FIG. 1, a prior art nail stapler 10 comprises a safety rod 11 received slidably in a nozzle 12 of the nail stapler 10 such that the bottom end of the safety rod 11 is extended under the nozzle 12, and that the top end of the safety rod 11 is located under a triggering mechanism 13. The triggering mechanism 13 has a trigger 14 and a pivoting piece 15 which is fastened pivotally with the trigger 14. The triggering mechanism 13 is corresponding in location to a firing button 16. Fastened with the top end of the safety rod 11 is an urging member 17 which has a top end urging the pivoting piece 15. The safety rod 11 and the urging member 17 are kept in the state of downward displacement by an elastic element 18 when the safety rod 11 and the urging member 17 are not exerted on by a force.

When the stapler 10 is not in operation, the bottom end of the safety rod 11 is located at a lower dead point indicated by the dotted lines. In the meantime, the pivoting piece 15 is not urged by the urging member 17. As the trigger 14 is actuated, no nail is fired in view of the fact that the firing button 16 is not activated by the pivoting piece 15. In order to allow the stapler 10 to fire the nails, the nozzle 12 must be pressed against the surface of a work piece so as to push the safety rod 11 to slide upward to locate at an upper dead point indicated by the solid lines, thereby causing the top end of the urging member 17 to urge the free end of the pivoting piece 15. As the trigger 14 is activated, the firing button 16 is actuated by the pivoting piece 15 so as to trigger the firing of nails. As soon as the nozzle 12 is disengaged with the surface of the work piece, the safety rod 11 and the pivoting piece 15 are urged by the elastic element 18 to return to the lower dead point.

The safety features of the prior art nail stapler described above are defective in design in that the safety rod 11 is vulnerable to an activation by accident, thereby resulting in an unintended firing of the nail.

SUMMARY OF THE INVENTION

It is therefore the primary objective of the present invention to provide a nail stapler capable of firing nail interruptedly or continuously.

It is another objective of the present invention to provide a nail stapler capable of firing one nail at a time without the risk of an accidental firing.

The foregoing objectives, features and functions of the present invention will be more readily understood upon a thoughtful deliberation of the following detailed description of the present invention in conjunction with the accompanying drawings.

DETAILED DESCRIPTION OF THE INVENTION

In view of simplifying the description of the interactions of the structural members of the present invention, certain structural members are appropriately deleted from the drawings provided herewith.

Figure 1:
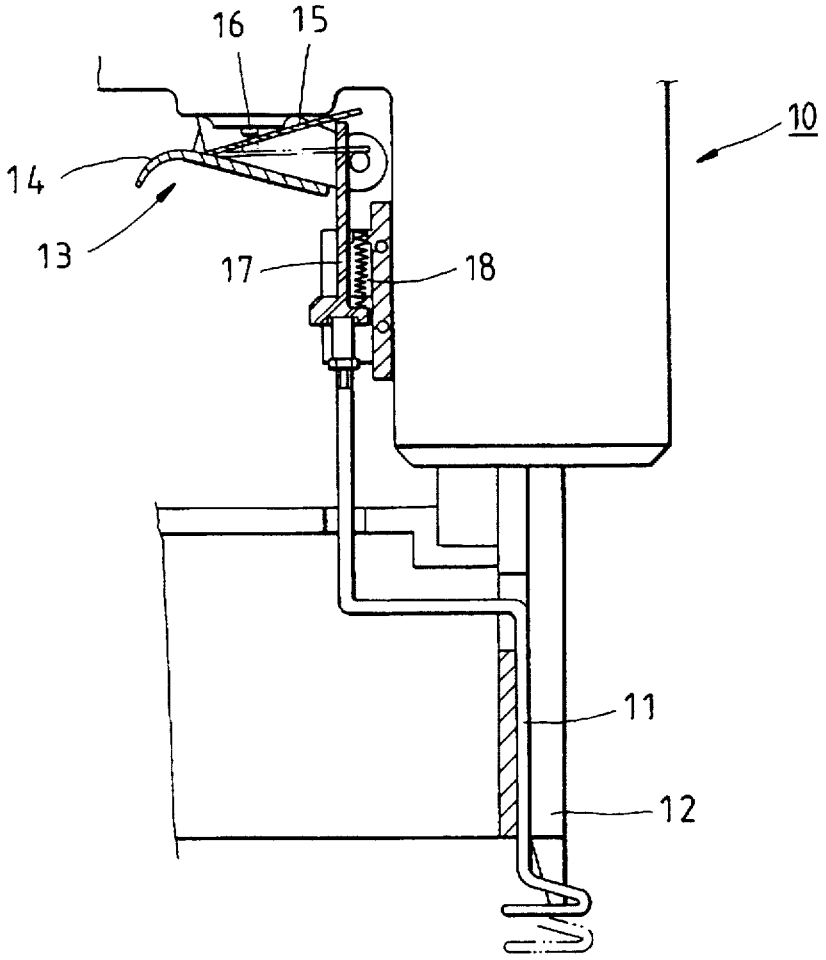
FIG. 1 PRIOR ART
FIG. 1 shows a schematic view of a nail stapler of the prior art.
Figure 2:
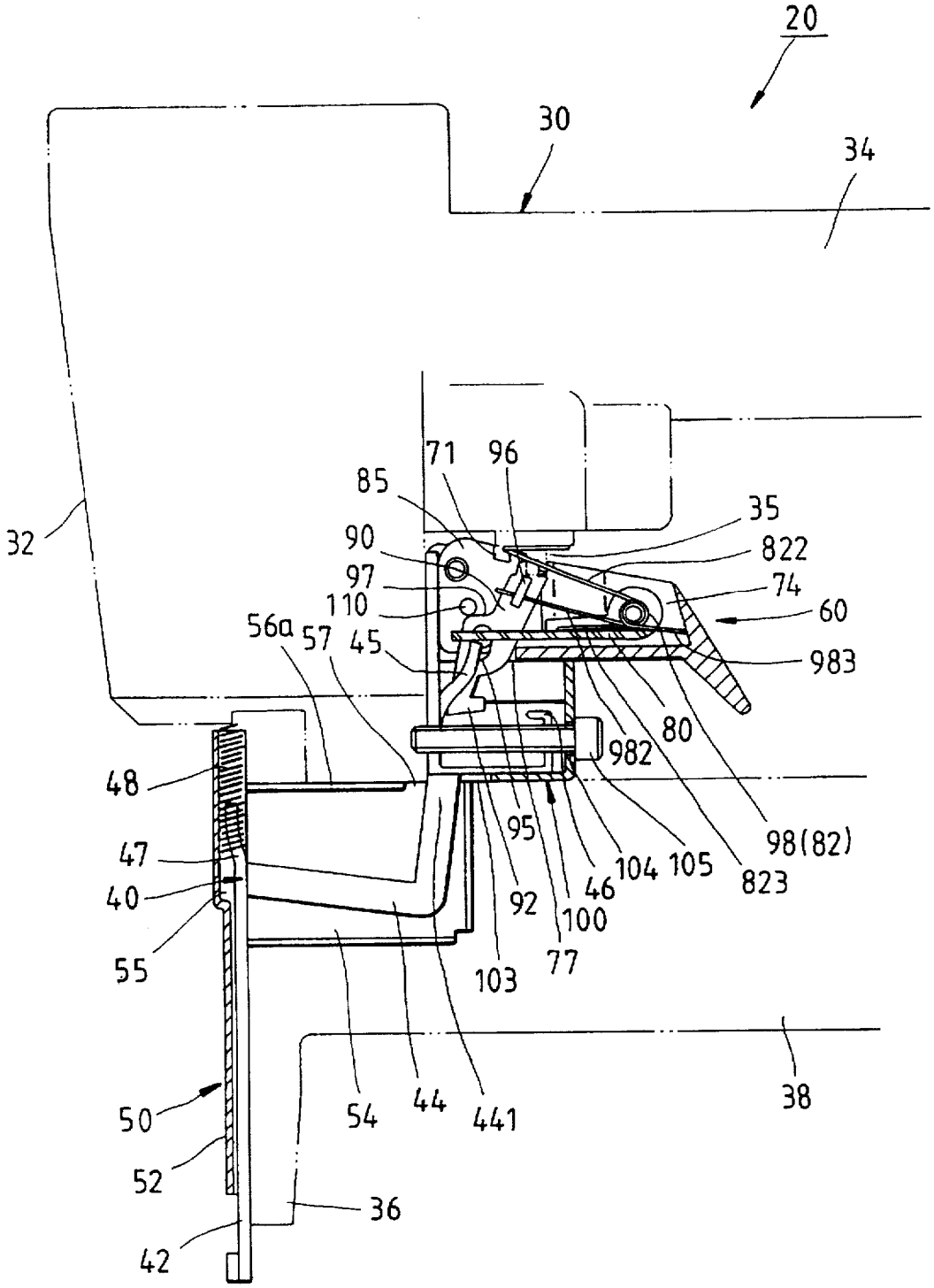
FIG. 2 shows a schematic view of a first preferred embodiment of the present invention which is set to fire continuously.

As shown in FIGS. 2 and 2, a nail stapler 20 embodied in the present invention is composed of the component parts, which are described explicitly hereinafter.

A stapler body 30 is indicated in the dotted lines and is composed of a cylinder 32 and a handle 34 which is provided with an air switch (not shown in the drawings) for controlling the actions of various members of the cylinder 32. The air switch has a firing button 35, which is located outside the stapler body 30. A muzzle 36 is mounted at the bottom of the cylinder 32 such that a fired nail is ejected therefrom. A nail clip 38 is mounted on the stapler body 30 such that the front end of the nail clip 38 is connected with the muzzle 36 and that the rear end of the nail clip 38 is fastened with a handle 34. The nails are held by the nail clip 38 such that the nails can be moved toward the front end of the nail clip 36 and that the nails can be forced out of the muzzle 36 by a firing pin located in the cylinder 32. A trigger 70 is mounted on the stapler body 30 such that the trigger 70 can be activated with finger to actuate the firing button 35.

A safety rod 40 is provided at the bottom end thereof with a contact portion 42 and a body 44 connected with the contact portion 42 and provided with an urging portion 45. The body 44 is further provided with a connection portion 46. A locating portion 47 is located on the safety rod 40, preferably on the contact portion 42 or the body 44. The safety rod 40 is located between the muzzle 36 and the nail clip 38 such that the safety rod 40 can be moved up and down within a predetermined range, and that the contact portion 42 is moved up and down along the axial direction of the muzzle 36, and further that the body 44 is located outside the nail clip 38. The urging portion 45 and the connection portion 46 are located under the air switch of the stapler body 30. An elastic element 48 is located between the safety rod 40 and the stapler body 30. When the safety rod 40 is not exerted on by an external force, the safety rod 40 is kept by the elastic energy of the elastic element 48 in the state of moving downwards so as to cause the bottom of the contact portion 42 to locate outside the muzzle 36. In this embodiment of the present invention, the elastic element 48 is a compression spring, whose one end is engaged with the locating portion 47 of the safety rod 40 while whose another end is engaged with the stapler body 30. The contact portion 42 is attached to the outer surface of the muzzle 36. The safety rod 40 is refrained by a cover piece 50, which has a front piece body 52 and a side piece body 54 perpendicular to the front piece body 52. Located longitudinally on the front piece body 52 is a receiving slot 55. The side piece body 54 is provided with a flat portion 56 having a top flat portion 56*a* provided with a cut 57. The front piece body 52 is fastened with the front end surface of the muzzle 36. The side piece body 54 is attached to the left side surface of the nail clip 38. The contact portion 42 and the elastic element 48 are covered by the receiving slot 55 of the cover piece 50. The body 44 of the safety rod 40 is covered by the side piece body 54. The top end 441 of the body 44 is located outside the cover piece 50 via the cut 57.

A triggering mechanism 60 comprises the component parts, which are described hereinafter.

A trigger 70 is provided with a receiving space 74 which is in turn provided with a partition 75 dividing the receiving space 74 into the receiving cell 76. The trigger 70 is further provided with an opening 77 and a recessed portion 78. The opening 77 is located in the bottom wall of the receiving space 74 such that the opening 77 is contiguous to the partition 75 and in communication with the receiving space 74. The recessed portion 78 is located in the top edge of one side wall of the trigger 70. The trigger 70 is fastened pivotally with the stapler body 30 by means of a pin 79 such that the trigger 70 is located under the air switch. The urging portion 45 of the safety rod 40 is received in the receiving space 74 via the opening 77. The connection portion 46 of the safety rod 40 is located under the trigger 70.

A pivoting piece 80 is fastened pivotally with the receiving space 74 of the trigger 70 by means of a pin 81 such that the pivoting piece 80 is capable of turning on the pivoting portion thereof, and that the free end of the pivoting piece 80 is urged by the urging portion 45 of the safety rod 40. A torsion spring 82 has a body 821 which is fitted over the pin 81 and is composed of two ends 822 and 823 which are rested against the pivoting piece 80. The pivoting piece 80 is kept in the state of swinging downwards by the torsion spring 82.

Figure 4:
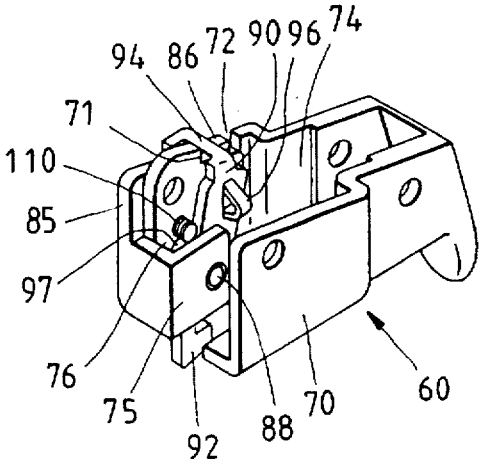
FIG. 4 shows a perspective view of a triggering mechanism of the present invention.

A refraining piece 85 is provided with a protruded portion 86 and is secured to the receiving cell 76 of the trigger 70 by the pins 79 and 88 such that the protruded portion 86 is corresponding in location to the recessed portion 78 of the trigger 70. The recessed portion 78 is divided by the protruded portion 86 into a first locating portion 71 and a second locating portion 72, as shown in FIG. 4.

A retaining member 90 of an elongated construction is provided with a retaining portion 92, a rod-shaped coupling portion 94, an oval slot 95, a connection portion 96, a wedge-shaped stopping portion 97, and an elastic element 98. The retaining member 90 is located in the receiving cell 76 of the trigger 70. The pin 88 is received in the oval slot 95 so as to enable the retaining member 90 to move up and down or turn. The retaining portion 92 is put through the receiving cell 76 to locate under the trigger 70 and to be contiguous to the connection portion 46 of the safety rod 40. The coupling portion 94 is placed across the trigger 70 and the wall of the refraining member 85, as shown in FIG. 4, and can be connected across the first and the second locating portions 71 and 72. The stopping portion 97 of the retaining member 90 is corresponding in location to the threaded hole 79 of the trigger 70 and the through hole 89 of the refraining member 85. The torsion spring 98 has a body 981 which is fitted over the pin 81 such that one end 982 of the body 981 is fastened with the connection portion 96 of the stopping member 90 and that another end 983 of the body 981 is pressed against the trigger 70 so as to keep the retaining member 90 in the state of urging downwards. The retaining member 90 may be located inside or outside the trigger 70.

A protective cover 100 is provided therein with a space 102, in the bottom wall thereof with a cut 103, and further in the one end surface thereof with a through hole 104. The protective cover 100 is fastened with the stapler body 30 by a bolt 105 such that the urging portion 45 and the connection portion 46 of the safety rod 40, and the retaining portion 92 of the retaining member 90 are all enclosed by the protective cover 100. The bolt 105 has a potential head with the urging portion 45, the connection portion 46 and the retaining portion 92. They will not interfere with one another so as to enable the members to remain in an operating state. The cut 103 is intended for the body 44 of the safety rod 40 to pass therethrough.

Figure 5:
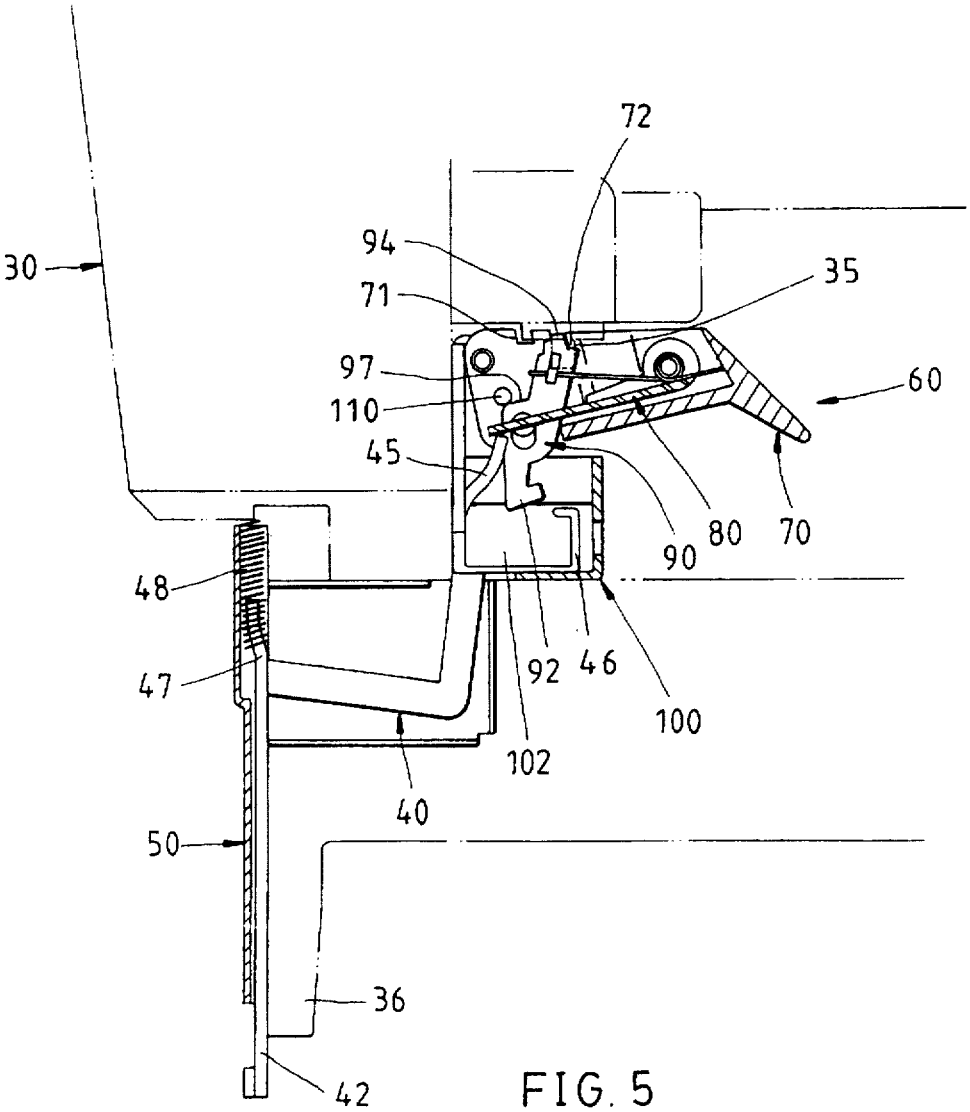
FIG. 5 is a schematic view showing that no firing of nail is brought about when the nail stapler of the present invention remains in the state as shown in FIG. 2, even if the trigger is activated.
Figure 6:
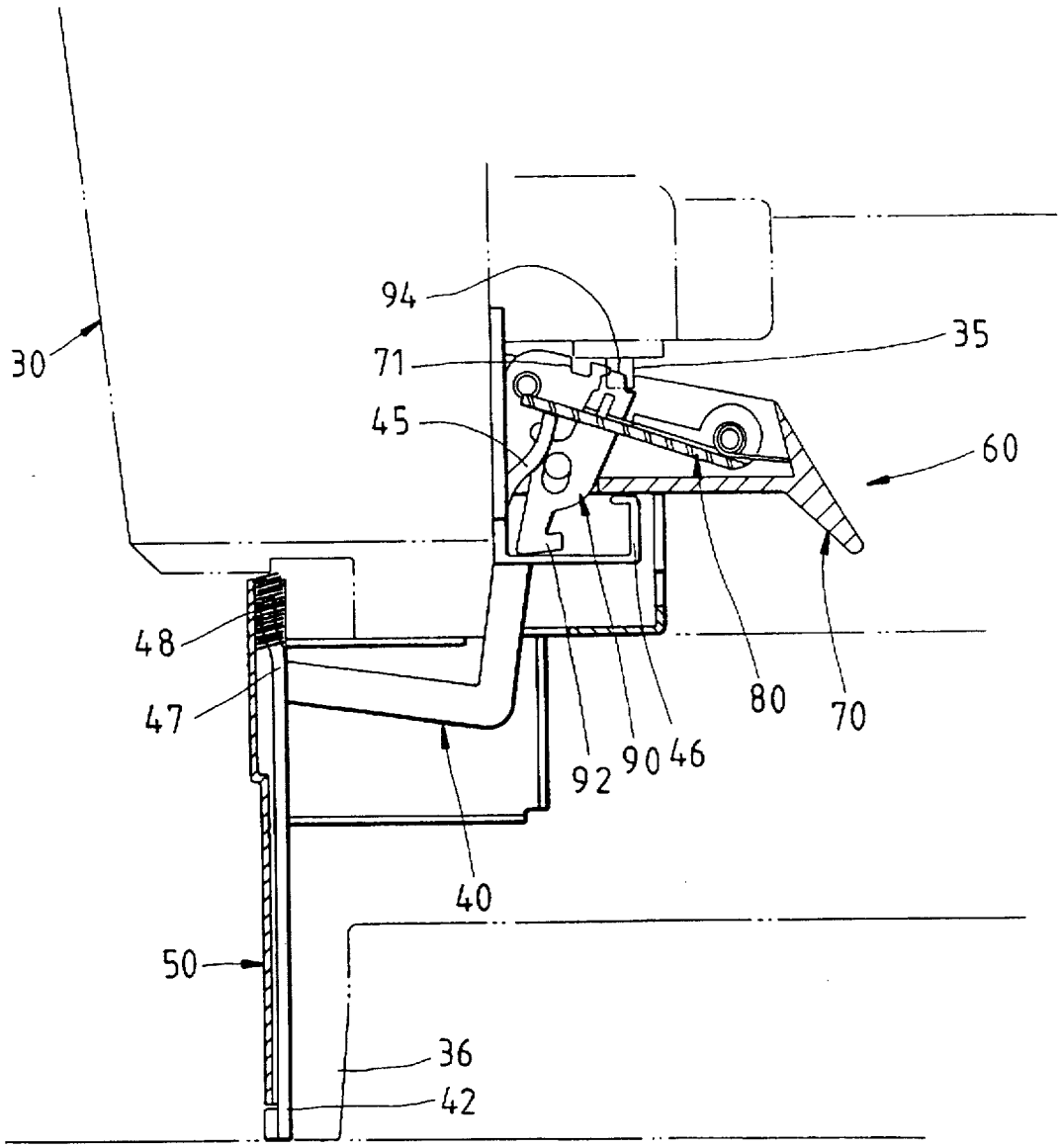
FIG. 6 is a schematic view showing that the safety rod of the first preferred embodiment of the present invention remains in contact with a work piece.
Figure 7:
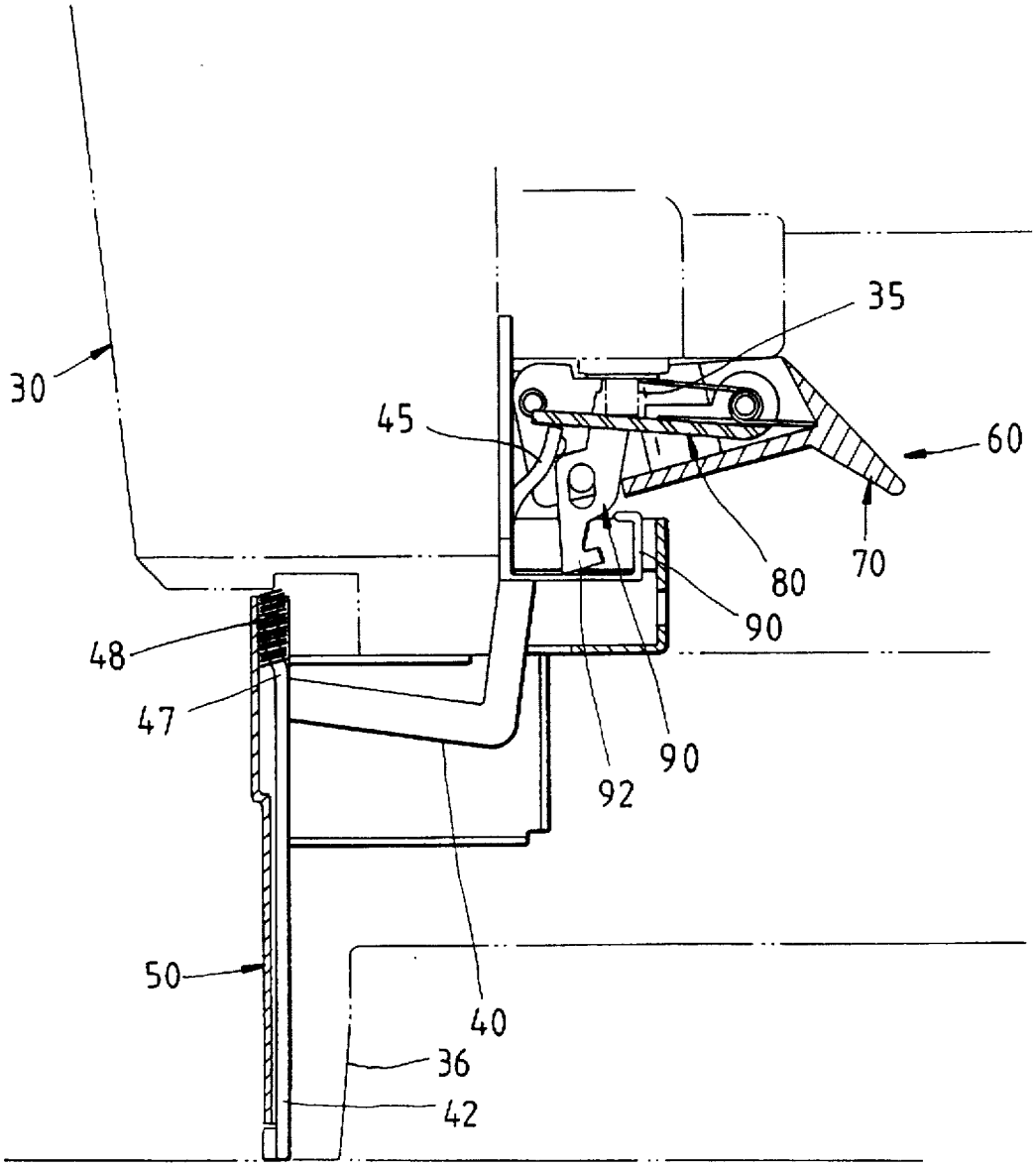
FIG. 7 is a schematic view showing that the trigger is activated when the stapler of the first preferred embodiment of the present invention remains in the state as shown in FIG. 5.

As shown in FIG. 2, the coupling portion 94 of the retaining member 90 is coupled with the second locating portion 72 of the trigger 70. In the meantime, the retaining member 90 is kept at a predetermined position. The nail stapler 20 of the present invention is thus ready for firing nails continuously. The retaining portion 92 of the retaining member 90 is caused to swing forward to remain apart from the connection portion 46 of the safety rod 40. When the trigger 70 is activated, as shown in FIG. 5, the firing button 35 is not hit by the pivoting piece 80. As a result, no nail is fired. When the muzzle of the nail staler is pressed against the surface of a work piece, as shown in FIG. 6, the safety rod 40 is caused to slide upwards such that the free end of the pivoting piece 80 is urged by the urging portion 45 of the safety rod 40. When the trigger 70 is activated, the pivoting piece 80 is actuated to hit the firing button 35 to result in the firing of a nail onto the work piece. Upon releasing the trigger 70 to return to the state as shown in FIG. 6, the safety rod 40 remains in the state of urging the pivoting piece 80. As the trigger 70 is activated, the firing of another nail is brought about, so as to result in the continuous firing of nails by the nail stapler 20. The user of the nail stapler 20 may also lift the stapler 20 to cause the muzzle 36 to disengage the surface of the work piece while the trigger 70 is kept inactivated. As a result, the safety rod 40 is urged by the elastic element 48 to move downwards to become disengaged with the pivoting piece 80. In the meantime, the contact portion 42 is once again located outside the muzzle 36 to remain in the state as shown in FIG. 5. The muzzle 36 is then once again pressed against the surface of the work piece to cause the safety rod 40 to move upwards to urge the pivoting piece 80 to hit the firing button 35, thereby resulting in the firing of a nail. In the continuous firing of nails, the safety rod 40 can be moved up and down freely in view of the fact the retaining portion 92 of the retaining member 90 is not engaged with the connection portion 46 at the time when the trigger 70 is kept inactivated.

Figure 8:
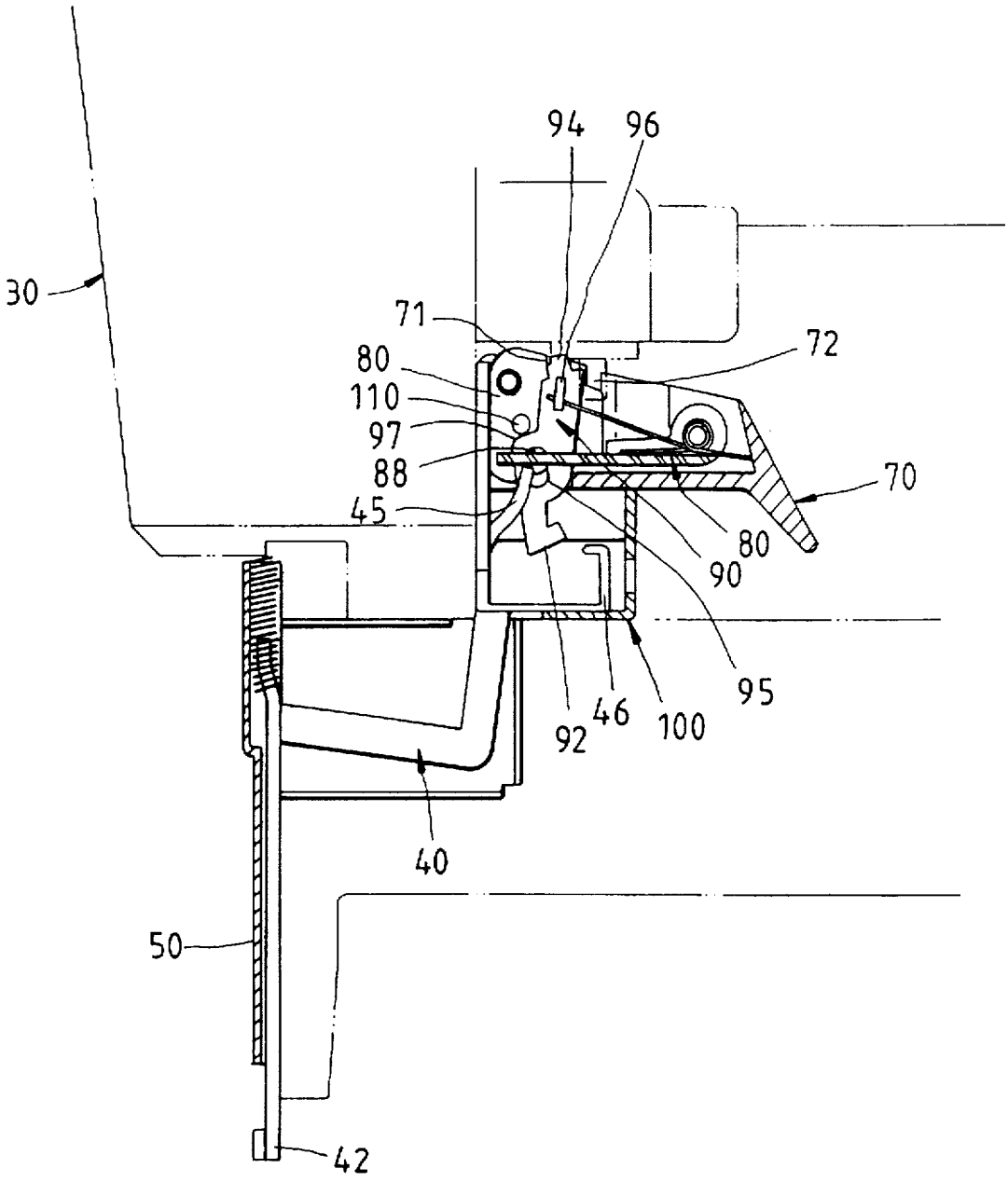
FIG. 8 is similar to FIG. 2 for showing that the nail stapler of the present invention is set for firing one nail at a time.

The nail stapler 20 of the present invention may be used in such a manner that only one nail is fired. The retaining member 90 is lifted to move along the direction of the axis of the oval slot 95 of the retaining member 90, so as to cause the coupling portion 94 to disengage the second locating portion 72 before the retaining member 90 is turned to cause the coupling portion 94 to move to locate over the first locating portion 71. Thereafter, the retaining member 90 is pushed downwards to cause the coupling portion 94 to engage securely the first locating portion 71, as shown in FIG. 8, such that the retaining portion 92 becomes closer to the connection portion 46. The nail stapler 20 is ready for firing the nail interruptedly.

Figure 9:
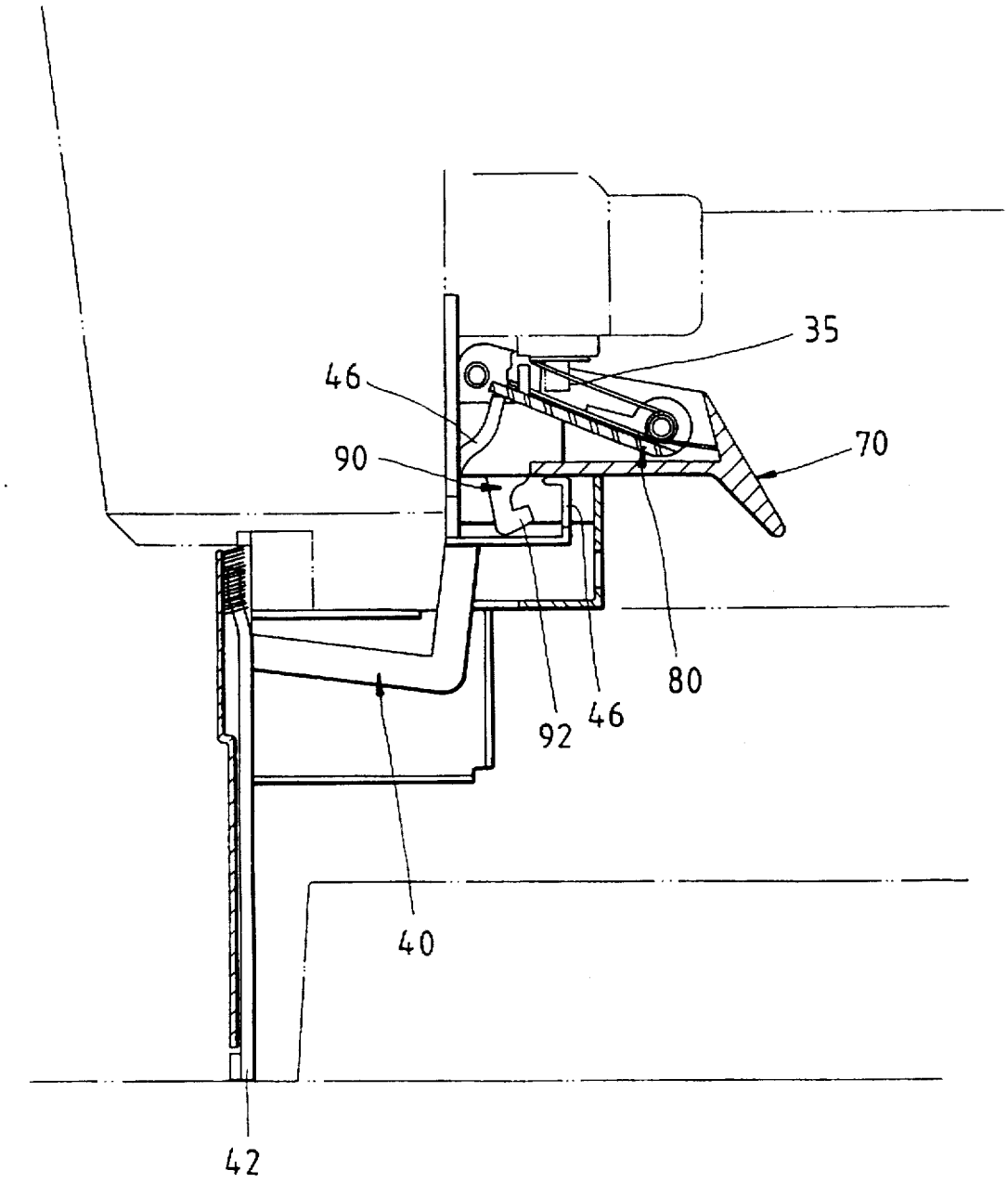
FIG. 9 is a schematic view showing that the safety rod of FIG. 8 is in contact with a work piece.
Figure 10:
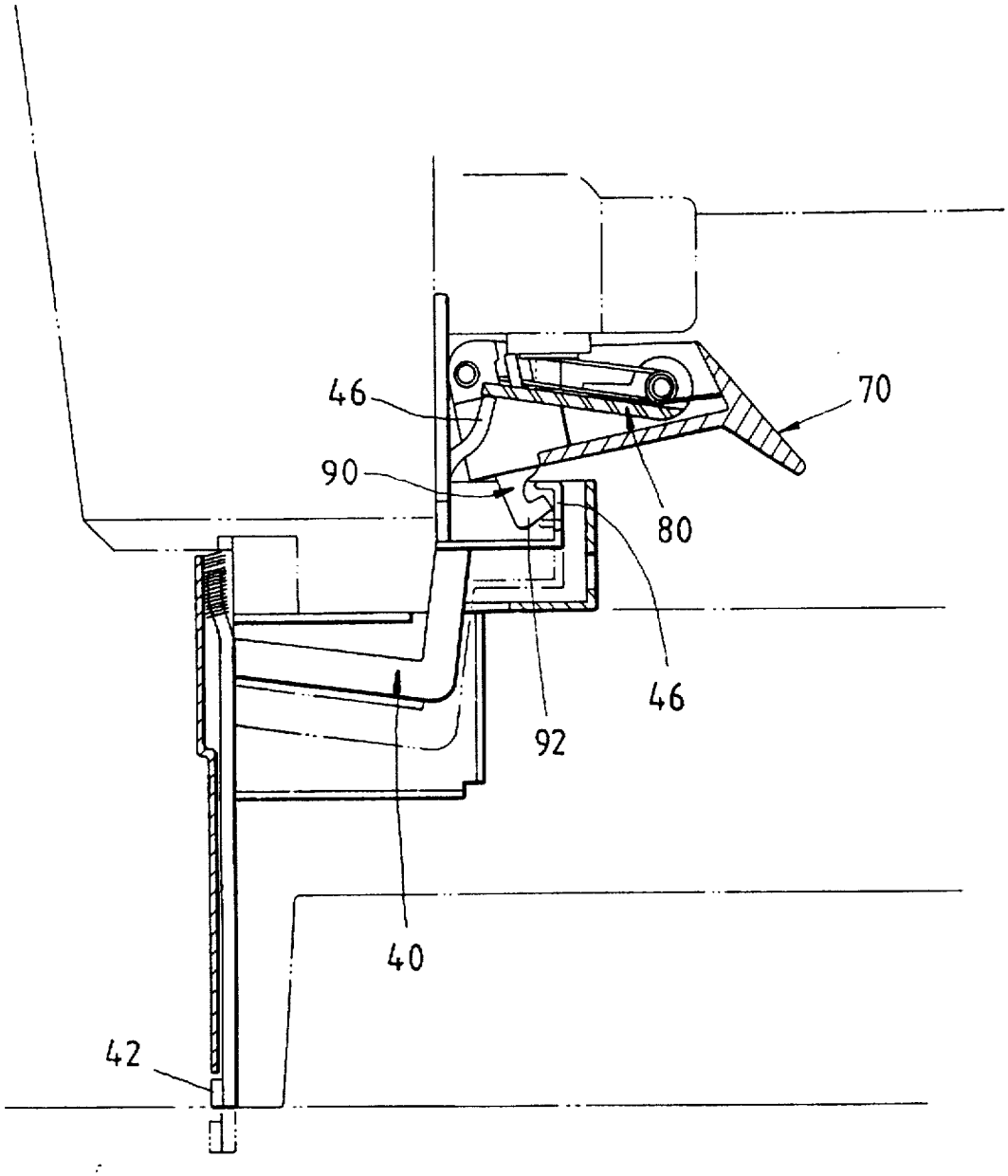
FIG. 10 is a schematic view showing that the trigger of FIG. 9 is activated.

In operation, the muzzle 36 is pressed against the surface of a work piece so as to cause the safety rod 40 to move upwards, as shown in FIG. 9, to urge the free end of the pivoting piece 80. As the trigger 70 is activated to cause the pivoting piece 80 to hit the firing button 35, thereby resulting in the firing of nail, as shown in FIG. 10. Since the retaining portion 92 and the connection portion 46 have a relatively smaller potential head, the retaining portion 92 is moved to locate under the connection portion 46 after the trigger 70 is activated. As the stapler body is lifted while the trigger 70 is kept being activated, the connection portion 46 is retained by the retaining portion 92. When the muzzle 36 is once again pressed against the surface of a work piece, no nail is fired in view of the fact that the firing button 35 is not relieved of the urging by the pivoting piece 80, and that the firing pin piston is incapable of returning to its original position. The operator of the nail stapler 20 of the present invention must let go the trigger 70 so as to cause the retaining portion 92 to disengage the connection portion 46, thereby resulting in the release of the firing button 35. Upon having released the trigger 70, repeat the motions described above to bring about the interrupted firing of nail. In order to prevent an accidental firing of nail, the muzzle 36 is pressed against the surface of a work piece while the trigger 70 is kept being activated, so as to cause the retaining portion 92 to obstruct the moving path of the connection portion 46 to unable the safety rod 40 to move inwardly. As a result, the firing button 35 remains intact.

Figure 3:
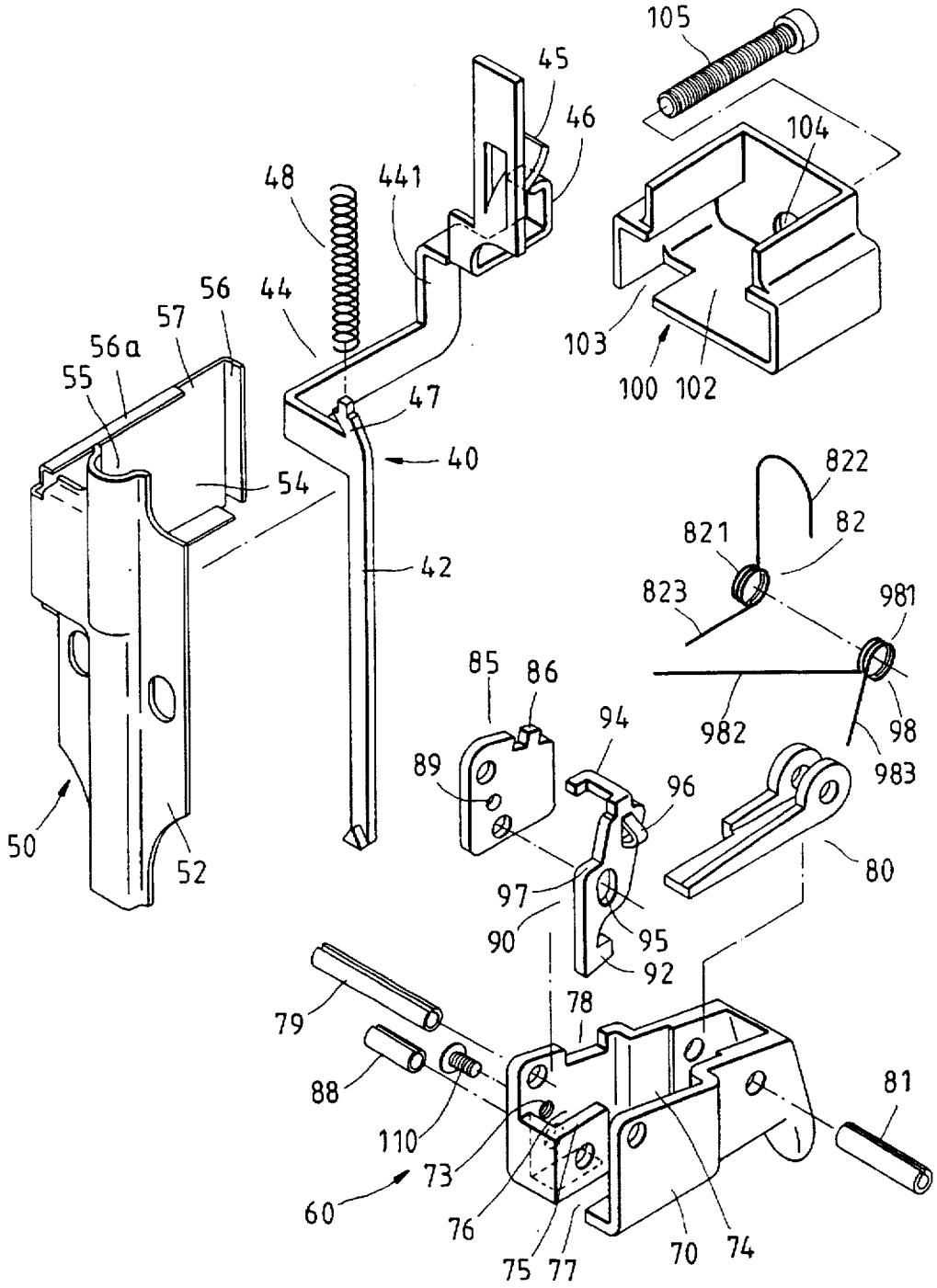
FIG. 3 shows an exploded view of the first preferred embodiment of the present invention such that the main body of the stapler is excluded.

The protective cover 100 is intended to prevent the retaining portion 92 and the connection portion 46 from being activated accidentally. The present invention is provided with a fixing member 110, such as a screw as shown in FIG. 3, to engage the fixing hole 73 of the trigger 70 and the through hole 89 of the refraining member 85 to extend into the receiving space 74. Regardless of the retaining member 90 which is set for firing nails interruptedly or continuously, the fixing member 110 is retained and stopped at the stopping portion 97 so as to fix the retaining member 90. Before the nail stapler 20 of the present invention is set for firing nails interruptedly or continuously, the fixing member 110 must be released so as to adjust the position of the retaining member 90.

Figure 11:
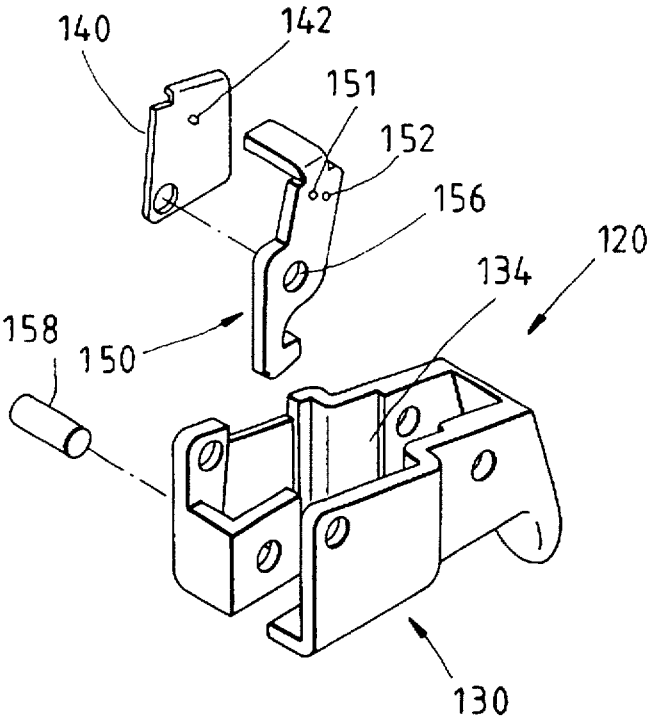
FIG. 11 shows a schematic view of the triggering mechanism embodied in another form according to the present invention.

As shown in FIG. 11, a triggering mechanism 120 of another embodiment of the present invention is similar in construction to the triggering mechanism 60 of the first preferred embodiment of the present invention, except that the former comprises the component parts, which are described hereinafter and shown in FIG. 11.

A refraining member 140 is fastened with a side wall of a trigger 130 and is provided with an arresting portion 142.

A retaining member 150 is provided with a first locating portion 152, a second locating member 154, a pivoting hole 156 engageable with a pin 158, so as to enable the retaining member 150 to be fastened pivotally in the receiving cell 134 of the trigger 130 in such a manner that the retaining member 150 can be displaced angularly, and that the first locating portion 152 and the second locating portion 154 are engageable with the arresting portion 142 by dialing the retaining member 150 for setting the angular position of the retaining member 150.

What is claimed is:

1. A nail stapler comprising:

a stapler body comprising a muzzle, a nail clip, in communication with said muzzle, and an air switch fastened with a handle of said stapler body;

a safety rod comprising a contact portion, a body, an urging portion located on said body, a connection portion located on said body and separated from said urging portion, said safety rod being located movably between said muzzle and said nail clip;

a first elastic member located between said stapler body and said safety rod for urging said contact portion of said safety rod to remain outside said muzzle when said safety rod is not exerted on by an external force; and a triggering mechanism comprising:

a trigger provided with a receiving space, and an opening in communication with said receiving space, said trigger fastened pivotally with said stapler body such that said trigger is located under said air switch, and that said trigger is located over said urging portion of said safety rod to permit said urging portion to pass through said opening of said trigger to locate in said receiving space of said trigger, and further that said connection portion of said safety rod is located outside said trigger;

a pivoting piece fastened pivotally at one end thereof in said receiving space of said trigger such that another end of said pivoting piece is in contact with said urging portion of said safety rod for triggering said air switch; and a retaining member provided with a retaining portion located on said trigger such that said retaining portion is corresponding in location to said connection portion of said safety rod, said retaining member being set at a first locating portion such that said retaining portion and said connection portion are not engaged with each other and that said safety rod can be moved freely at such time when said trigger is activated, said retaining member being set at a second locating portion such that said retaining portion and said connection portion are engaged with each other and that said safety rod can not be moved freely at such time when said trigger is activated.

2. The nail stapler as defined in claim 1, wherein said retaining portion of said retaining member is not engageable with said connection portion of said safety rod when said retaining member is set at said first locating portion and when said trigger is activated; and wherein said retaining portion of said retaining member is engageable with said connection portion of said safety rod when said retaining member is set at said second locating portion and when said trigger is activated.

3. The nail stapler as defined in claim 2, wherein said trigger is provided on a side wall thereof with a first locating portion and a second locating portion; and wherein said retaining member comprises a body which is provided with a slot and a coupling portion and is fastened pivotally with said trigger by a pin engaging said slot, said coupling portion being engageable with said first locating portion and said second locating portion.

4. The nail stapler as defined in claim 3, wherein said trigger is provided in a side wall thereof with a recessed portion, and a refraining member having a protruded portion having a width smaller than a width of said recessed portion and corresponding in location to said recessed portion to form a first locating portion and a second locating portion.

5. The nail stapler as defined in claim 3, wherein said receiving space of said trigger is provided with a partition for forming a receiving cell; and wherein said retaining member is located in said receiving cell.

6. The nail stapler as defined in claim 2, wherein said trigger is provided in a side wall thereof with a predetermined number of arresting portions; and wherein said body of said retaining member is provided with a predetermined number of locating portions engageable with said arresting portions.

7. The nail stapler as defined in claim 6 further comprising a refraining member located on said side wall of said trigger; and wherein said arresting portions are located on said refraining member.

8. The nail stapler as defined in claim 6, wherein said retaining member is provided with a stopping portion; and wherein said trigger is provided detachably with a fixing member capable of being stopped by said stopping portion when said retaining member is located at said first locating portion or said second locating portion.

9. The nail stapler as defined in claim 6, wherein said receiving space of said trigger is provided with a partition for forming a receiving cell; and wherein said retaining member is located in said receiving cell.

10. The nail stapler as defined in claim 2 further comprising a protective cover fastened between said trigger and said nail clip such that said protective cover encloses said retaining portion of said retaining member and said connection portion of said safety rod.

11. The nail stapler as defined in claim 2, wherein said contact portion of said safety rod is attached to said muzzle and received in a receiving slot of a cover piece fastened with said muzzle; and wherein said first elastic element is received in said receiving slot such that one end of said first elastic element urges said contact portion, and the another end of said elastic element urges said stapler body.

12. The nail stapler as defined in claim 11, wherein said safety rod is disposed such that the body of said safety rod is exposed in a side of said nail clip; and wherein said cover piece has a front piece body and a side piece body perpendicular to said front piece body which is provided with said receiving slot and is located at one end of said muzzle, said side piece body being fastened with a side of said nail clip such that said body of said safety rod is covered by said side piece body, and that one end of said body of said safety rod is located outside said side piece body.

13. The nail stapler as defined in claim 2, wherein said trigger comprises a receiving cell located in said receiving space of said trigger; and wherein said retaining member is located in said receiving cell.

14. The nail stapler as defined in claim 2, wherein said trigger comprises a receiving cell located in an outer wall of said trigger; and wherein said retaining member is located in said receiving cell.

15. The nail stapler as defined in claim 1 further comprising a second elastic element mounted on said trigger such that said second elastic element is fastened at one end thereof with said retaining member, and that another end of said second elastic member urges said stapler body.

16. The nail stapler as defined in claim 1, wherein said trigger is provided on a side wall thereof with a first locating portion and a second locating portion; and wherein said retaining member comprises a body which is provided with a slot and a coupling portion and is fastened pivotally with said trigger by a pin engaging said slot, said coupling portion being engageable with said first locating portion and said second locating portion.

17. The nail stapler as defined in claim 1, wherein said trigger is provided in a side wall thereof with a predetermined number of arresting portions; and wherein said body of said retaining member is provided with a predetermined number of locating portions engageable with said arresting portions.

18. The nail stapler as defined in claim 1 further comprising a protective cover fastened between said trigger and said nail clip such that said protective cover encloses said retaining portion of said retaining member and said connection portion of said safety rod.

19. The nail stapler as defined in claim 1, wherein said contact portion of said safety rod is attached to said muzzle and received in a receiving slot of a cover piece fastened with said muzzle; and wherein said first elastic element is received in said receiving slot such that one end of said first elastic element urges said contact portion, and the another end of said elastic element urges said stapler body.

20. The nail stapler as defined in claim 1, wherein said trigger comprises a receiving cell located in said receiving space of said trigger; and wherein said retaining member is located in said receiving cell.

21. The nail stapler as defined in claim 1, wherein said trigger comprises a receiving cell located in an outer wall of said trigger; and wherein said retaining member is located in said receiving cell.

* * * * *